United States Patent [19]

Bigelow

[11] 4,128,787

[45] Dec. 5, 1978

[54] DC POP WITH VARISTOR CONNECTED BETWEEN CONTROL CIRCUIT AND CATHODE

[75] Inventor: John E. Bigelow, Clifton Park, N.Y.

[73] Assignee: General Electric Company, Schenectady, N.Y.

[21] Appl. No.: 894,735

[22] Filed: Apr. 10, 1978

[51] Int. Cl.[2] ..... H05B 37/00; H05B 39/00; H05B 41/00

[52] U.S. Cl. ..... 315/169 TV; 340/324 R

[58] Field of Search ..... 315/169 R, 169 TV; 340/324 M, 324 R

[56] References Cited

U.S. PATENT DOCUMENTS 3,811,071 5/1974 Ogle ..... 315/169 TV 3,855,500 12/1974 Yanagisawa ..... 315/169 TV

*Primary Examiner*—Alfred E. Smith
*Assistant Examiner*—Robert E. Wise
*Attorney, Agent, or Firm*—Geoffrey H. Krauss; Joseph T. Cohen; Marvin Snyder

[57] ABSTRACT

Gas discharge displays of the planar electrode type and having a plurality of anode or cathode electrodes connected together on a common matrix address line utilize resistive elements, having a current-voltage characteristic varying in highly exponential manner, in series between the commmon matrix line and each of the paralleled cathode or anode electrodes to facilitate current sharing therebetween during normal operation while allowing "run-in" of the displays at relatively greater than normal currents.

5 Claims, 6 Drawing Figures

DC POP WITH VARISTOR CONNECTED BETWEEN CONTROL CIRCUIT AND CATHODE

BACKGROUND OF THE INVENTION

The present invention relates to gas discharge displays and, more particularly, to a novel gas discharge display having means for enhancing current sharing between a plurality of electrodes coupled to a common matrix line.

Gas discharge displays of the planar electrode type offer several advantages as low cost displays. In addition to the generally pleasing appearance of such displays, the display format is of relatively great flexibility, in that information display areas may generally be changed by substitution of a mask during the display process step in which conductive electrodes are fabricated on a glass substrate. To provide greater flexibility, the design of a particular gas discharge display will often require that a number of the cathode or anode electrodes of such display be connected together in electrical parallel connection to a common matrix address line. However, it is known that the current drawn by each energized section, or cell, of a gas discharge display is related to the area of the electrodes thereof; the brightness and, subsequently, the contrast of each energized display cell is related to the current drawn thereby. Thus, display areas having electrodes of substantially equal areas will draw substantially equal current and have substantially equal brightness and contrast against the normally-dark background (in which a discharge is not facilitated through the gaseous medium of the display). If the electrode areas are other than substantially equal, the current discharging through the display gas is not equal for all paralleled sections and some means, generally adding to the cost and complexity of the display, is required to promote current-sharing between the several electrodes. It is known that an electrical resistance, placed in series connection between each of the electrodes and the common matrix line of appropriate value, be provided to facilitate such current-sharing at very low cost. It has been impractical to utilize such series resistance current-sharing techniques, due to the requirement that, during manufacture of gas discharge displays, a "run-in" period is required during which relatively greater than normal currents must flow through the display; the high-current "run-in" requirements directly conflict with the requirement for relatively high series resistance for normal-operation current-sharing. It is, therefore, desirable to have a gas discharge display of structure enabling the relatively high current run-in procedure to be utilized, while providing some means for obtaining current-sharing between a plurality of paralleled discharge electrodes comparable to a common display matrix address line.

BRIEF SUMMARY OF THE INVENTION

In accordance with the invention, a gas discharge display has a pair of planar, spaced-apart substrates upon the facing interior surfaces on which are fabricated aligned conductive electrodes, of pattern and number commensurate with the information to be displayed. A plurality of the electrodes are coupled to a common conductive lead. An element, in series between each electrode and the common lead, is comprised of a resistance material having a non-linear, highly exponential current-voltage characteristic. The non-linear material is selected to provide relatively low resistance for relatively high currents, as required during the "run-in" period, yet have a relatively high resistance at current levels associated with normal information display operation of the gas discharge display.

In a preferred embodiment, the material is a film of thyrite or GEMOV ® varistor material, which may be paralleled by a thin film resistance, to achieve the desired non-linear current versus voltage characteristic.

Accordingly, it is an object of the present invention to provide a novel gas discharge display having means for providing current-sharing between a plurality of electrodes coupled to a common matrix address line, while facilitating greater than normal current flow to the plurality of electrodes during "run-in".

This and other objects of the present invention will be apparent upon consideration of the following detailed description taken in conjunction with the accompanying drawings.

DETAILED DESCRIPTION OF THE INVENTION

Figure 1A:
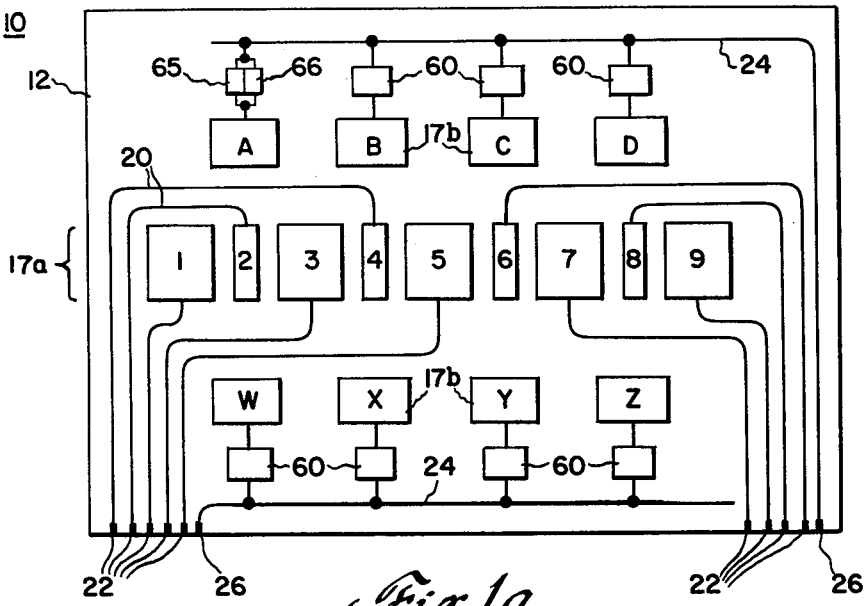
FIG. 1*a* is a front view of an electrode-bearing substrate for a gas discharge display in accordance with the principles of the present invention, and taken along lines 1*a*—1*a* of FIG. 1.
Figure 1:
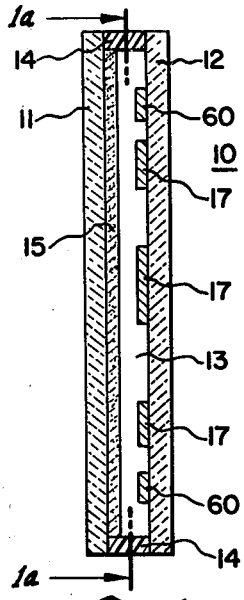
FIG. 1 is a side view of a gas discharge display.

Referring now to FIGS 1 and 1*a*, a gas discharge display 10 comprises a planar, substantially transparent front substrate 11, formed of glass and the like materials, parallel to and spaced from a planar rear substrate 12. The insulative substrates are maintained in overlapped parallel relationship, and the volume 13 therebetween sealed in gas-impervious manner, by spacer means 14 extending about, and sealed to, the entire peripheries of the facing interior surfaces of both substrates. A thin film 15 of a conductive, substantially transparent material, such as tin oxide, indium oxide and the like, is fabricated upon the interior surface of transparent front substrate 11, to form one electrode, e.g. the anode, for the entire gas discharge display. A plurality of electrodes 17, i.e. cathodes, are fabricated to a conductive material upon the interior surface of rear substrate 12; each cathode electrode is separated from all other cathode electrodes and is of a size, shape and position as required to define the various symbols, characters and indicia to be displayed by discharge excitation of the gas, in volume 13, between energized cathode 17 and the anode 15 upon the interior surface of the front substrate.

Referring particularly to FIG. 1*a*, two types of cathode electrodes may be identified: a plurality of electrodes 17*a* comprising individual cathode electrodes 1–9, each coupled via an associated single conductive lead 20 to a pad 22, upon an edge of the substrate, to which pad the cathode connection for the single electrode is completed; and other cathode electrodes 17*b*, i.e. electrodes A-D and W-Z, a plurality of which are coupled in electrical parallel connection to a single lead 24, terminated at a single edge-connector pad 26. The parallel-connected cathode electrodes 17b present a current-sharing problem, which is not present with respect to the individually connected cathode electrodes 17a, each having its separate connection pad 22 and lead 20.

Figure 2:
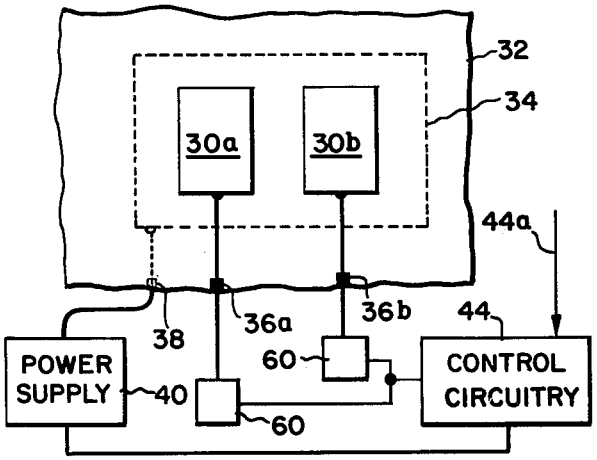
FIG. 2 is a schematic representation of a gas discharge display, illustrating the nature of the problem to be solved and of the solution thereto.

The nature of the current-sharing problem is best illustrated upon consideration of FIG. 2, in which a pair of cathode electrodes 30a and 30b are fabricated upon the surface of a substrate 32; an anode electrode 34, shown in broken line, is fabricated above the plane of electrodes 30a and 30b and had an area at least coextensive with the areas of both cathode electrodes. Each of cathode electrodes 30a and 30b is connected to a separate lead pad 36a and 36b, respectively, while anode electrode 34 is coupled to its own lead pad 38, upon a front substrate (not shown for purposes of simplicity in this Figure). A power supply 40, of current and voltage sufficient to cause a discharge in the gas between anode 34 and either or both electrodes 30a and 30b, is coupled between anode lead pad 38 and a common bus 42. Control circuitry 44 is connected between bus 42 and cathode electrode pads 36a and 36b and energizes both cathode electrodes 30a and 30b responsive to a control signal at control input 44a.

Figure 3:
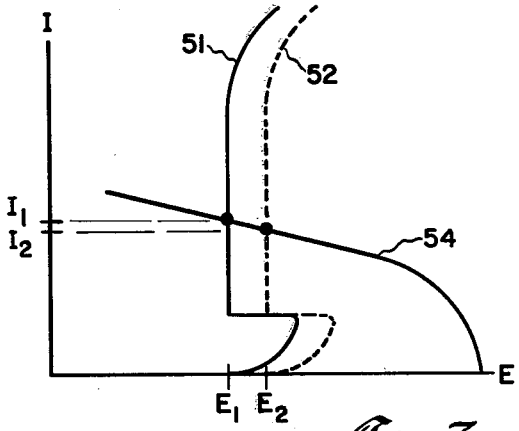
FIGS. 3, 4 and 5 are graphs respectively illustrating the current-sharing problem between a pair of electrodes, the load-line operation of the display, and the current-voltage characteristics of the non-linear series element in the resulting novel display in accordance with my invention.

The current versus voltage curves for slightly dissimilar cathode electrodes 30a and 30b is shown in FIG. 3. It will be seen that one of the cathode electrodes, e.g. electrode 30a, causes the gas to discharge at a slightly lower voltage than the other electrode, e.g. electrode 30b, and that the current for the lower-firing-potential cathode, along solid curve 51, should be the same current as that drawn by the display cell with higher voltage requirements, as represented by broken curve 52. The output current versus voltage curve 54 of control circuitry 44 establishes the operating point of each of the two cells, each associated with one of cathode electrodes 30a and 30b, at the intersection of control circuitry 54 and the associated IE curve 51 or 52 for the cell. Thus, upon receiving a stimulus at input 44a, the control circuitry provides an electrical potential to the paralleled cathode electrodes; both electrodes begin to conduct, with the electrode associated with curve 51 having a conduction voltage slightly less than the electrode associated with curve 52. The gas display cell associated with electrode 30a (curve 51) thus has a conduction-voltage thereacross slightly less than the conduction voltage for the remaining cell associated with electrode 30b (curve 52) and the conduction voltage of the first cell is typically less than the voltage required to cause the remaining cell to conduct. Therefore, only one of the two paralleled cells causes a gas discharge and only half of the desired message is displayed.

Figure 4:
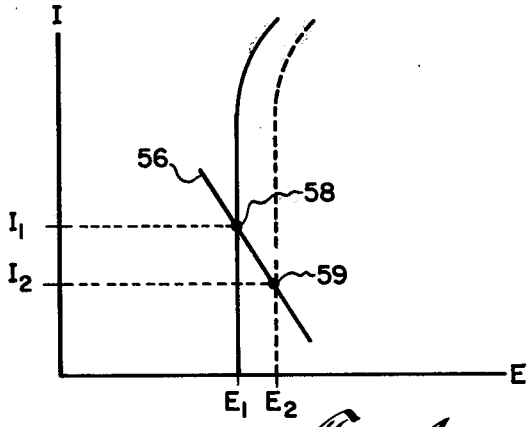

This problem may be alleviated if an electrical resistance is placed in electrical series connection between the control circuitry output, as represented by common lead 24 (FIG. 1a) at each of the plurality of cathode electrodes 17b (FIG. 1a) or 30a and 30b (FIG. 2) to be coupled thereto. If these resistors are of sufficiently high value, such that $E_2-E_1 = (I_1 - I_2)R$, where R is the resistance value in series with each cathode electrode, the proper excitation voltage for electrode is provided, even though the different electrodes operate at slightly different currents. This operation is graphically illustrated in FIG. 4, wherein the load line 56 passes through both operating point 58 for a first display cell and operating point 59 for the other display cell. These resistors may be provided by fabricating resistor material directly upon the surface of the substrate, as by silk screening and the like. However, the manufacturing process required for fabrication of a typical gas discharge display requires that the display be operated at a "run-in" current which is several times larger than the normal operating current; the voltage drop across each resistance would then become excessively large and would reduce the potential across all cells to that less than the discharge-sustaining potential, as well as present the problem of excessive heating of the relatively low-power-dissipation resistances.

Figure 5:
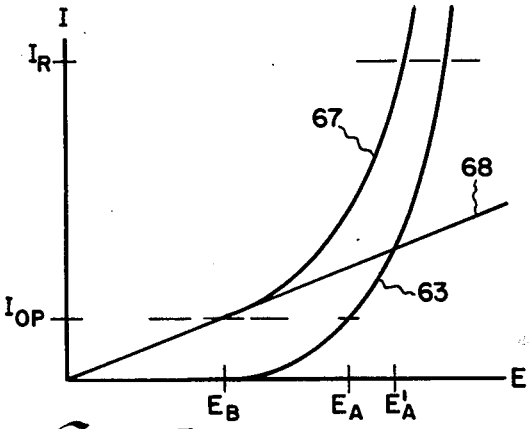

In accordance with the invention, resistances 60 are of a type having a non-linear voltage-current characteristic, such as provided by fabricating thin non-linear varistor elements of thyrite of GEMOV ® material and the like. The varistor characteristic 63 (FIG. 5) allows each cell to conduct the normal operating current ($I_{op}$) for a voltage $E_A$ applied across the cell, and to conduct a relatively larger run-in current $I_R$ with a somewhat larger voltage $E_A'$ applied thereacross. The normal operation of the cell is, however, affected in that the normal varistor characteristic curve does not contribute sufficient resistance at normal operating currents.

Preferably, each element 60 in electrical series connection between the common lead and each of the plurality of electrodes 17b, is fabricated of a first layer or film 65 of a resistance material having a linear resistance characteristic, in parallel with a second layer of film 66 of a resistance material having varistor characteristics. This may be accomplished by providing two side-by-side layers, or by utilizing a varistor slurry having a matrix made sufficiently conductive to obtain the additional, linear resistance characteristics at low voltages. The series element 60 now has a resistance characteristic substantially equal to the sum of the resistance curve 63 of the varistor material and a constant-slope characteristic curve 68 of the linear resistance material. It will be observed that the run-in current $I_R$ is obtained with a higher voltage than the normal operating potential, but, with the normal operating, potential $E_B$, operation on a portion of curve 67 having sufficiently high resistance to enable each of the paralleled electrodes to operate at the normal operating current $I_{op}$, is obtained.

It should be understood that the particular varistor material, be it zinc-oxide, vanadium-oxide or the like, and the particular resistance properties thereof, must be selected from the available varistor compositions for the resistance characteristic desired for the particular gas discharge display in which the varistor material is to be used.

There has just been described a gas discharge display having an element of non-linear resistance characteristics in electrical series connection between a common lead line and each of a plurality of display electrodes, with the non-linear resistance element facilitating the use of relatively high "run-in" current while allowing current-sharing to occur between the plurality of electrodes in normal operation.

While the present invention has been described with reference to one preferred embodiment, many variations and modifications will now occur to those skilled in the art. It is my intent, therefore, to be limited only by the appending claims, and not by the specific embodiment described herein.

What is claimed is:

1. A gas discharge display comprising:
a first planar electrode structure;
a multiplicity of electrodes fabricated independent of one another in a plane substantially parallel to, and spaced from, said planar electrode structure;
a gas filling the volume between said planar electrode structure and said plurality of electrodes;
a conductive lead to be coupld to a plurality of the multiplicity of electrodes; and
a non-linear electrical resistance element in electrical series connection between each of said plurality of electrodes and said conductive lead.

2. The gas discharge display as set forth in claim 1, wherein the non-linear resistance element is fabricated of a varistor material.

3. The gas discharge display as set forth in claim 2, wherein the varistor material is selected from the group consisting of zinc-oxide and vanadium-oxide varistor materials.

4. The gas discharge display as set forth in claim 2, wherein said non-linear resistance element is a matrix of varistor material having conductive material suspended therein.

5. The gas discharge display as set forth in claim 1, further comprising a linear resistance element in electrical parallel connection across said non-linear resistance element, the parallel combination having a current-voltage characteristic providing a finite value of resistance between each of said plurality of electrodes and said conductive lead for a first flow of current to each of said plurality of electrodes and a second resistance, greater than said resistance, for a second magnitude of current flow greater than said first current flow magnitude.

* * * * *